United States Patent [19]

Tai

[11] 4,451,387

[45] May 29, 1984

[54] SUDS CONTROL AGENTS AND DETERGENT COMPOSITIONS CONTAINING THEM

[75] Inventor: Loui H. T. Tai, Santes, France

[73] Assignee: Lever Brothers Company, New York, N.Y.

[21] Appl. No.: 409,398

[22] Filed: Aug. 19, 1982

[51] Int. Cl.[3] ..... C11D 10/06

[52] U.S. Cl. ..... 252/174.15; 252/89.1; 252/90; 252/174.13; 252/174.17; 252/321; 252/358; 252/558

[58] Field of Search ..... 252/89.1, 174.15, 174.13, 252/174.17, 558, 321, 358, 91

[56] References Cited

U.S. PATENT DOCUMENTS

| | | | |
|---|---|---|---|
| 4,013,573 | 3/1977 | Leiklim et al. | 252/142 |
| 4,013,574 | 3/1977 | Leiklim et al. | 252/174.15 |
| 4,235,742 | 11/1980 | Anderson et al. | 252/358 |
| 4,264,465 | 4/1981 | Abel | 252/321 |
| 4,265,779 | 5/1981 | Gandolfo et al. | 252/358 |

FOREIGN PATENT DOCUMENTS

| | | |
|---|---|---|
| 40091 | 11/1981 | European Pat. Off. . |
| 2462184 | 2/1981 | France . |
| 1492939 | 11/1977 | United Kingdom . |

*Primary Examiner*—Roland E. Martin, Jr.
*Assistant Examiner*—Hoa Van Le
*Attorney, Agent, or Firm*—Milton L. Honig; James J. Farrell

[57] ABSTRACT

Suds control agents for addition to detergent compositions are prepared by a granulation process. In the process core particles of gelatinised starch are granulated with a silicone oil admixed with hydrophobic silica. The granules are then coated with wax by spraying from a solution in an organic solvent. Typically the granules produced contain 45–55%, silicone oil compound 35–50% and wax 7–15% gelatinized starch.

6 Claims, No Drawings

SUDS CONTROL AGENTS AND DETERGENT COMPOSITIONS CONTAINING THEM

This invention relates to detergent compositions containing suds control agents and to a process for their manufacture.

Detergent compositions, particularly fabric washing detergent powders, which produce only a relatively small amount of suds in washing machines are gaining an increasing share of the European market as automatic (drum-type) washing machines become more widespread. While existing products generally use a mixture of soaps for controlling suds produced by anionic surfactants, or by mixtures of anionic and nonionic surfactants, it is now generally accepted in the industry that such products are not ideal, since the soap tends to have adverse effects, for example, on powder properties. Consequently, there are now a large number of proposals in the literature for alternative suds-control agents which do not contain soap. One example of such a proposal is that in British Pat. No. 1,492,939 which discloses, amongst other things a silicone-based suds contol agent. This suds-control agent involves the use of an adsorbent carrier, and as examples of such carriers, sodium carbonate, sodium tripolyphosphate, sodium silicate, clay, starch, Kieselguhr and Fuller's Earth are listed.

We have now discovered that gelatinised starch is a useful material for forming the basis of a silicone-based suds control agent in that it has an optimum combination of sorbency and solubility characteristics.

Accordingly, in a first aspect, the present invention provides a detergent composition comprising an anionic surfactant and a suds-control agent, characterised in that the suds-control agent comprises a core of gelatinised starch having a mixture of a silicone oil and hydrophobic silica adsorbed thereon. This mixture of silicone oil and hydrophobic silica will now be referred to as a silicone oil compound.

It is strongly preferred that the suds-control agent is coated with a layer of wax, preferably paraffin wax, since we have discovered that the storage characteristics of such coated agents are superior to those of uncoated ones.

In its second aspect, the invention provides a process for making a detergent composition characterised by the steps of (a) granulating a gelatinised starch with a silicone oil compound to form granules having a weight average particle size of from 200 to 1000 microns and having the silicone compound sorbed thereon.

(b) coating the granules with a wax preferably by spraying them with a solution of a wax in an organic solvent and in that case subsequently evaporating the organic solvent; and (c) admixing the resultant suds-control agent with the remainder of the composition.

The essential feature of both aspects of this invention is the use of gelatinised starch for the adsorbent core of the suds-control agent. Gelatinised starch is essentially a partially hydrolysed starch which can be obtained by suspending granules of starch, such as maize starch, in water and drying the suspension in steam heated drums. In the work described in this specification we have used gelatinised starches sold under the registered Trade Mark "Amijel" by Société des Produits du Mais of Clamart, France, but we believe that other gelatinised starches will be just as effective.

The suds-control effect of silicone oil compounds is quite easily deactivated and two factors in the characteristics of the gelatinised starch which have been found to be important are its ionic character and its pH. We prefer, for the stability reason referred to, that the gelatinised starch should be nonionic in character and also that the pH should be in the range 5.5 to 9.

Further important characteristics of the gelatinised starch are its particle size and its particle size distribution. Small particle size, that is to say a weight average particle size of from 50 to 500 microns is important from the viewpoint of maximising the surface area of the gelatinised starch, so that it can adsorb as much silicone oil compound as possible. The particle size distribution is preferred to be narrow so that if it is decided to granulate the gelatinised starch, then the resultant granules are relatively uniform in size and shape. The subsequent coating with a layer of wax is then more likely to be of uniform thickness and to be coherent than if particles of a widely different particle size are used to form the granule.

The silicone oils used in the silicone oil compounds of the invention are generally from the chemical class of alkyl polysiloxanes. These materials are well known to industrial chemists and are available in a wide range of molecular weights, the higher molecular weight materials, as is usually the case with polymers, tending to be more viscous. Silicone oils are available from various suppliers, and Dow Corning Corporation of Illinois, USA, and Rhône-Poulenc Chemie, supply mixtures of silicone oils and silicas of various types, including hydrophobic silicas, which we have found very satisfactory for use as silicone oil compounds in this invention.

The process of this invention involves a granulation or agglomeration step. Granulation and agglomeration are well-known techniques in which liquid is added to particles of a solid, with agitation, and in which large particles are formed. The "Eirich" pan (registered Trade Mark) is an apparatus which is well-known in the food and detergents industry which was developed especially for granulation processes. However, it is also possible to use fluidised bed apparatus such as the "Anhydro" fluidised bed (registered Trade Mark) for granulation or, more preferably a Schugi (registered Trade Mark) mixer. This type of mixer consists essentially of a closed cylinder provided with a set of mixer blades rotatable about its major axis. The blades are of variable pitch and are arranged so that they can impart a spiral mixing motion to particles in the mixer. The side-walls of the cylinder are provided with spray nozzles for the introduction of liquid.

The process also involves a coating step and this can be a spraying step in which a solution of a wax in an organic solvent is sprayed onto the granules produced in the previous step. The solvent is then evaporated to leave a coherent coating of the wax on the granules. Alternatively a molten wax can be used in the coating step.

The type of wax used is not critical since, as it is present in only a relatively thin layer, it will dissolve off the granules or agglomerates in the warm, detergent-rich environment of the wash liquor. However, it is preferred that the softening point of the wax should be below the temperature at which washing generally takes place, that is to say below about 80° C. For compositions intended for low temperature washing, waxes of correspondingly low softening points will be appropriate. It is becoming increasingly common for wash temperatures to be specified at as low as 60° or even 40° C. We prefer to use paraffin wax of these softening points, but there is no reason why other waxes, should not be used.

The relative proportions of the essential components in the preferred suds-control agents of the invention can vary quite widely, although since the gelatinised starch is intended to be present as an adsorbent it will normally be present in an amount greater than the silicone oil which it is intended to adsorb. Preferred relative proportions are:

| | |
|---|---|
| gelatinised starch | 45–55% |
| silicone oil compound | 35–50% |
| wax | 7–15%, |

the percentages being based on the total weight of the suds-control agent.

The suds-control agent will normally be present in detergent compositions in accordance with the invention in amounts of from 0.1 to 2%, preferably 0.1 to 1%.

It will be understood that this invention is concerned with a suds-control agent and consequently no attempt has been made in this specification to describe all possible detergent compositions to which the component could be added. It is self-evident that the usual detergent composition components are appropriate provided that they have no adverse reaction with the components of the suds-control agent. For example, anionic surfactants such as alkylbenzene sulphonates, primary and secondary alkyl sulphates, secondary alkane sulphonates, soaps and olefine sulphonates can be used. Nonionic surfactants, either alone or in combination with anionic surfactants can also be used, the preferred nonionic surfactants being $C_7$ to $C_{24}$ primary or secondary alcohols ethoxylated with from 1 to 25 moles of ethylene oxide per mole of alcohol. Typical amounts of surfactant are from 3 to 25% by weight when only one species is present, and from 1 to 16% by weight when more than one is present.

Builders may be present in amounts of from 5 to 50% by weight. Typical of the inorganic builders are sodium tripolyphosphate, sodium pyrophosphate and sodium orthophosphate, sodium carbonate and the crystalline and amorphous forms of aluminosilicates. Organic builders such as sodium nitrilotriacetate, sodium citrate, sodium carboxymethyloxysuccinate, and the host of other materials have been been suggested as phosphate replacers are also appropriate.

Other components which may be present are sodium silicate as a corrosion inhibitor and powder structurant, oxygen bleaches such as sodium perborate and sodium percarbonate, bleach precursors such as tetraacetylethylene diamine, fluorescers, antiredeposition agents and antiashing agents, suds-suppressing agents other than the silicone granules of the invention, and moisture.

The invention will be further illustrated in the following Examples.

EXAMPLE 1

A fabric washing powder having the following formulation was prepared by conventional spray-drying and dry-dosing techniques:

| | % by weight |
|---|---|
| Sodium dodecylbenzene sulphonate | 7.5 |
| $C_{16-20}$ fatty alcohol 25EO | 1.6 |
| $C_{13-15}$ fatty alcohol 11EO | 1.0 |
| Sodium tripolyphosphate | 34.0 |
| Sodium silicate | 6.0 |
| Sodium perborate | 24.0 |
| Moisture and minor components | 25.6 |

To this formulation was added 0.3% of a suds control agent in accordance with the invention which was prepared as follows.

54 parts of gelatinised starch (Amigel 30076) having a weight average particle size of 340 microns was granulated in an Eirich pan ganulator while 38 parts of a mixture of a silicone oil and hydrophobic silica sold by Dow Corning Corporation under the trade mark Silicone oil DB100 was sprayed onto it. A solution of 7.5 parts of paraffin wax in chloroform was sprayed onto the granules, which were then weathered to evaporate the solvent which was recovered. The granules were then dusted with 0.5 parts of finely-divided silica to prevent stickiness. The washing powder produced in this way containing the gelatinised starch-based granules was then divided into two. The first portion was submitted immediately to the suds assessment test which is described below, while the second portion was stored at 37° C. for 1 month before being submitted to the test.

The suds assessment test is performed by washing a standard load of clean washing in a Brandt 433 (registered trade mark) washing machine. The washing machine was specially modified to provide a window and the window had an arbitrary scale on it from which suds height could be read. The reservoir holding the wash liquor is fitted with a thermometer.

In a series of experiments the height of suds which is developed by each powder at various temperatures is determined. The results are shown in Table 1.

TABLE 1

| | Suds Height Cms | |
|---|---|---|
| Temperature °C. | Fresh Powder | After Storage |
| 30 | neg | 14 |
| 40 | 8 | 32 |
| 50 | 10 | 36 |
| 60 | 6 | 19 |
| 70 | 7 | 22 |
| 80 | 8 | 24 |
| 90 | 9 | 24 |

It can be seen from the above Table that although there is some deactivation of the suds-control effectiveness of the granules after storage for a month at 37° C., it is by no means severe. Considering that in the absence of any suds control agent the suds height would rise to over 60 cms almost immediately the washing process started, this relatively slight deactivation would be perfectly acceptable in commercial practice.

EXAMPLE 2

A similar experiment to that in Example 1 was performed, but in this example the suds-control granules were prepared from 46 parts of the gelatinised starch and 46 parts of the silicone oil compound.

The granules were combined with the remaining components of the fabric washing powder, and the suds control performance of the powder was assessed as described above except that the powder formulation contained 1% of sodium hardened rape seed oil soap and a correspondly reduced amount of water. The results of the suds control assessment are shown in Table 2.

TABLE 2

| Temperature °C. | Suds Height (cms) Fresh powder | After Storage |
|---|---|---|
| 20 | 10 | 7 |
| 30 | 4 | 8 |
| 40 | 10 | 12 |
| 50 | 10 | 12 |
| 60 | 6 | 6 |
| 70 | 8 | 4 |
| 80 | 11 | 5 |
| 90 | 5 | 8 |

It is again apparent that although some deactivation of the suds-control effectiveness of the granules occurs, it remains within acceptable limits. The effect of the combination of the granules with soap is apparent.

I claim:

1. A detergent composition comprising an anionic surfactant and an effective amount of a suds control agent, characterized in that the sud control agent comprises:

(i) a core of gelatinized starch, in an amount from about 45 to 55%;

(ii) a silicon oil composition, in an amount from about 35 to 50%, sorbed thereon, the silicone oil composition being a mixture of silicone oil and hydrophobic silica; and (iii) the silicone sorbed core coated with a wax in an amount of from about 7 to 15%;

the percentage being based on the total weight of the agent.

2. A detergent composition according to claim 1, further characterised in that the particle size of the core of gelatinised starch is from 50 to 500 microns.

3. A detergent composition according to claim 1, further characterized in that the suds control agent is present in an amount of from 0.1 to 1% by weight of the composition.

4. A detergent composition according to claim 1, further characterized in that the gelatinised starch is a nonionic gelatinised starch.

5. A detergent composition according to claim 1, further characterized in that the pH of the gelatinised starch is from 5.5 to 9.

6. A process for making a detergent composition according to claim 1, 2, 3, 4 or 5, characterised by the steps (a) granulating a gelatinised starch with a silicone oil compound to form granules having an average particle size of from 200 to 1000 microns and having the silicone oil compound adsorbed thereon;

(b) spraying the resultant granules with a solution of a wax in an organic solvent; (c) subsequently evaporating the organic solvent; and (d) admixing the resultant suds-control agent with the remainder of the composition.

* * * * *